US005478205A

United States Patent [19]

Chou et al.

[11] Patent Number: 5,478,205

[45] Date of Patent: Dec. 26, 1995

[54] IMPELLER FOR TRANSVERSE FAN

[75] Inventors: Rudy S. T. Chou, Liverpool; Peter R. Bushnell, Cazenovia, both of N.Y.

[73] Assignee: Carrier Corporation, Syracuse, N.Y.

[21] Appl. No.: 206,702

[22] Filed: Mar. 7, 1994

[51] Int. Cl.[6] ..... F04D 29/66

[52] U.S. Cl. ..... 416/178; 416/203; 415/119

[58] Field of Search ..... 416/203, 178, 416/187; 415/119, 53.1

[56] References Cited

U.S. PATENT DOCUMENTS

| | | |
|---|---|---|
| 4,538,963 | 8/1985 | Sugio et al. . |
| 5,094,586 | 3/1992 | Takada et al. . |
| 5,266,007 | 11/1993 | Bushnell et al. . |

FOREIGN PATENT DOCUMENTS

| | | | |
|---|---|---|---|
| 12098 | 2/1981 | Japan | 415/119 |
| 17295 | 1/1985 | Japan | 416/203 |
| 19990 | 2/1985 | Japan | 415/119 |
| 193099 | 8/1989 | Japan | 416/178 |

*Primary Examiner*—Edward K. Look
*Assistant Examiner*—James A. Larson

[57] ABSTRACT

A transverse fan impeller (10) having blades (31) that extend longitudinally parallel to the rotational axis of the impeller. Each blade has an airfoil cross section, defined by a chord line (Ch) and a camber line (Ca), and is positioned in the impeller at a setting angle (Γ). The outermost edge (Eo) of each blade is located at a distance (Rmax) from the rotational axis (Ar, Ar'). The angular spacing (Σ) between blades in the fan is uniform. Among the blades of the impeller, the values of at least one of the parameters distance from outermost edge to rotational axis (Rmax), length of chord line (Ch), maximum deviation of camber line from chord line (Dmax) and setting angle of blades vary randomly from reference values of these parameters. The random parametric variations reduce the blade rate tonal noise produced by a fan having such an impeller as compared to a fan having an impeller with uniform blade parameters.

6 Claims, 3 Drawing Sheets

IMPELLER FOR TRANSVERSE FAN

BACKGROUND OF THE INVENTION

This invention relates generally to the field of air moving apparatus such as fans and blowers. More specifically, the invention relates to an impeller for use in fans of the transverse type. Transverse fans are also known as cross-flow or tangential fans.

The operating characteristics and physical configuration of transverse fans make them particularly suitable for use in a variety of air moving applications. Their use is widespread in air conditioning and ventilation apparatus. Because such apparatus almost always operates in or near occupied areas, a significant design and manufacturing objective is quiet operation.

FIG. 1 shows schematically the general arrangement and air flow path in a typical transverse fan installation. FIG. 2 shows the main features of a typical transverse fan impeller. Fan assembly 10 comprises enclosure 11 in which is located impeller 30. Impeller 30 is generally cylindrical and has a plurality of blades 31 disposed axially along its outer surface. Impeller 30 comprises several modules 32, each defined by an adjacent pair of partition disks 34 or by one end disk 33 and one partition disk 34. Between each adjacent pair of disks longitudinally extend a plurality of blades 31. Each blade is attached at one of its longitudinal ends to one disk and at the other end to the other disk of the pair. A given impeller may comprise multiple modules as depicted in FIG. 2 or but a single module, where the blades attach at either end to an end disk. The choice of a single or multiple module configuration depends upon such factors as fan size, construction material strength and weight and the like. As impeller 30 rotates, it causes air to flow from enclosure inlet 21 through inlet plenum 22, through impeller 30, through outlet plenum 23 and out via enclosure outlet 24. Rear or guide wall 15 and vortex wall 14 each form parts of both inlet and outlet plena 22 and 23. The general principles of operation of a transverse fan need not be elaborated upon except as necessary to an understanding of the present invention.

When a transverse fan is operating, it generates a certain amount of noise. One significant component of the total noise output of the fan is a tone having a frequency related to the rotational speed of the fan multiplied by the number of fan blades (the blade rate tone). The passage of the blades past the vortex wall produces this blade rate tone. Discrete frequency noise is in general more irritating to a listener than broad band noise of the same intensity. The blade rate tone produced by the typical prior art transverse fan has limited the use of such fans in applications where quiet operation is required.

At least one prior art disclosure has proposed a means of reducing the blade rate tonal noise produced by a transverse fan. U.S. Pat. No. 4,538,963 (issued 3 Sep. 1985 to Sugio et al.) discloses a transverse fan impeller in which the circumferential blade spacing (called pitch angle in the patent) is random.

Another patent, U.S. Pat. No. 5,266,007 (issued 30 Nov. 1993 to Bushnell et al.), one inventor of which is also an inventor of the present invention and the assignee of which is the same as the assignee of the present invention, discloses a transverse fan impeller that is effective in reducing the blade rate tonal noise in a transverse impeller by varying the angular spacing of the impeller blades in a nonuniform but also nonrandom manner.

It is the interaction between air flow, rather than the fan blades themselves, and the vortex wall that produces the blade rate tone in a transverse fan. Therefore one can reduce the blade rate tone by any means that reduces the regularity of the air flow interaction at the vortex wall.

SUMMARY OF THE INVENTION

The present invention is a transverse fan impeller having a configuration that reduces the noise associated with the blade rate tone compared to that produced by a conventional transverse fan impeller. We have achieved this reduction by randomly varying certain blade parameters among the blades of the impeller. This results in a random variation in the air flow that interacts with the vortex wall thus reducing the blade rate tone.

The blades of the impeller have an airfoil cross section. The airfoil has a chord and a camber. The chord of each blade is set at an angle with respect to a radius passing through the axis of rotation of the impeller and the intersection of the chord and camber lines at the inside edge of the blade. The outermost edge of each blade is at some radial distance from the axis of rotation of the impeller. It is at least one of the parameters, that is, length of chord, maximum deviation of camber line from chord, setting angle and distance of outermost edge from rotational axis, that varies randomly, within limits, among the blades. In one embodiment, only the length of chord varies, in another only the maximum deviation, in another only the setting angle and still another on the distance of leading edge. Random variation in all of the parameters is possible. Any of the various embodiments is effective in reducing radiated noise from the fan. The random variation in configuration, if held within the specified limits, will not adversely affect fan performance.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 2:
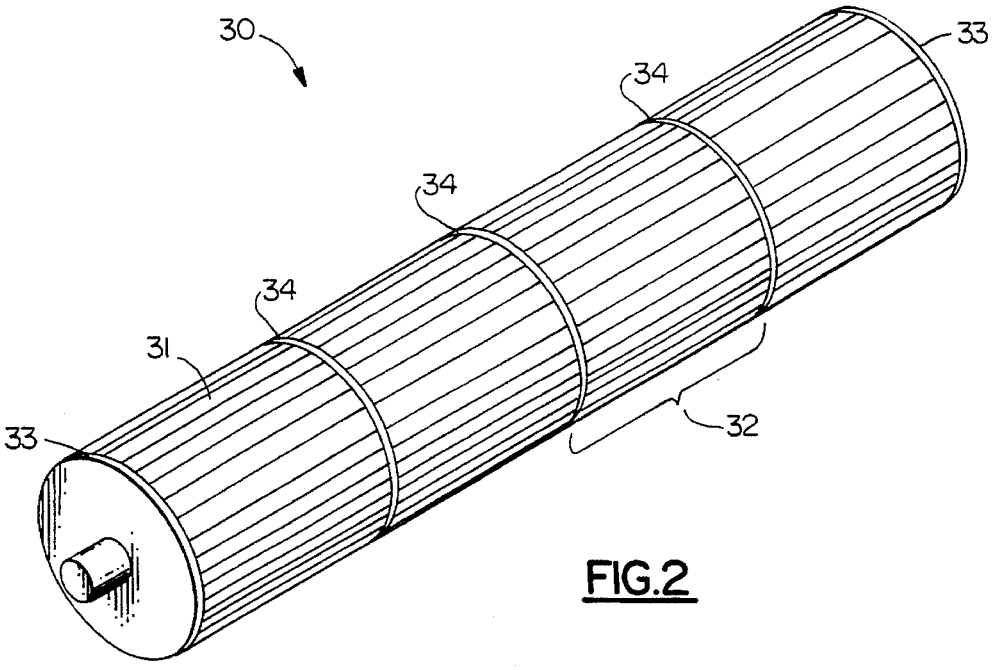
FIG. 2 is an isometric view of a transverse fan impeller.
Figure 1:
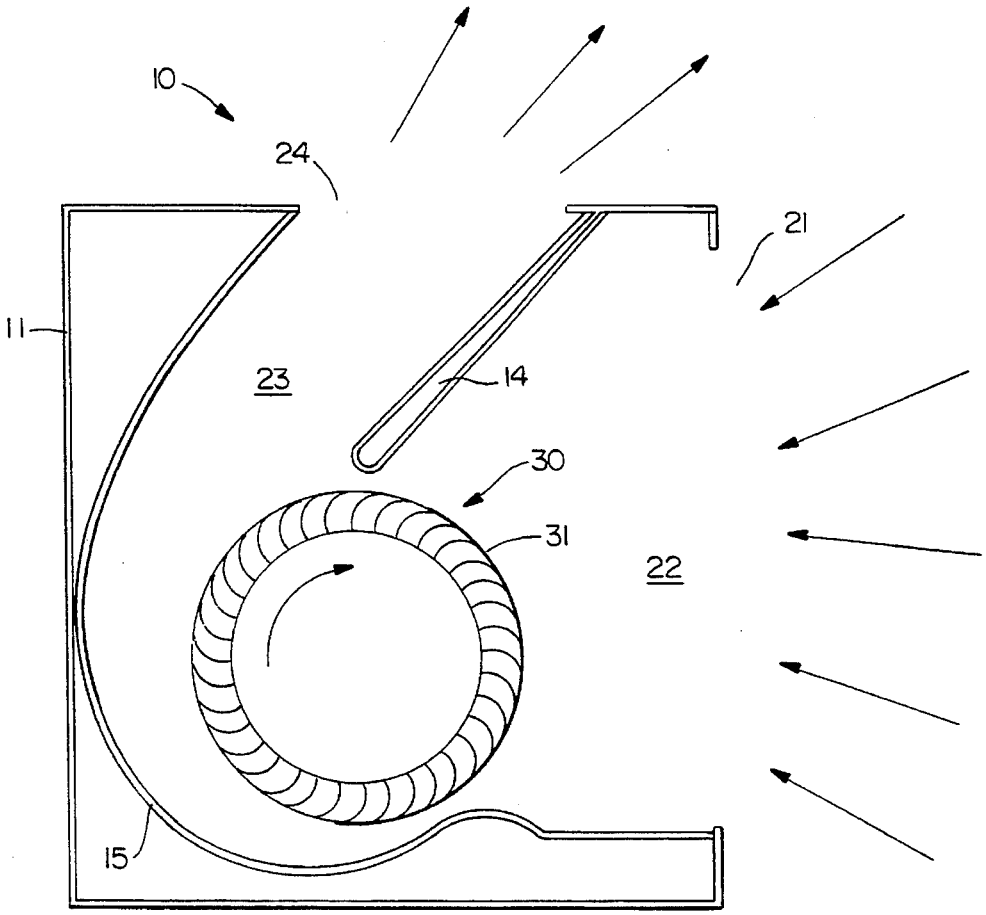
FIG. 1 is a schematic view of a typical transverse fan arrangement.

The BACKGROUND OF THE INVENTION section above, referring to FIGS. 1 and 2, provides information concerning the basic construction and operation of a transverse fan.

Figure 3:
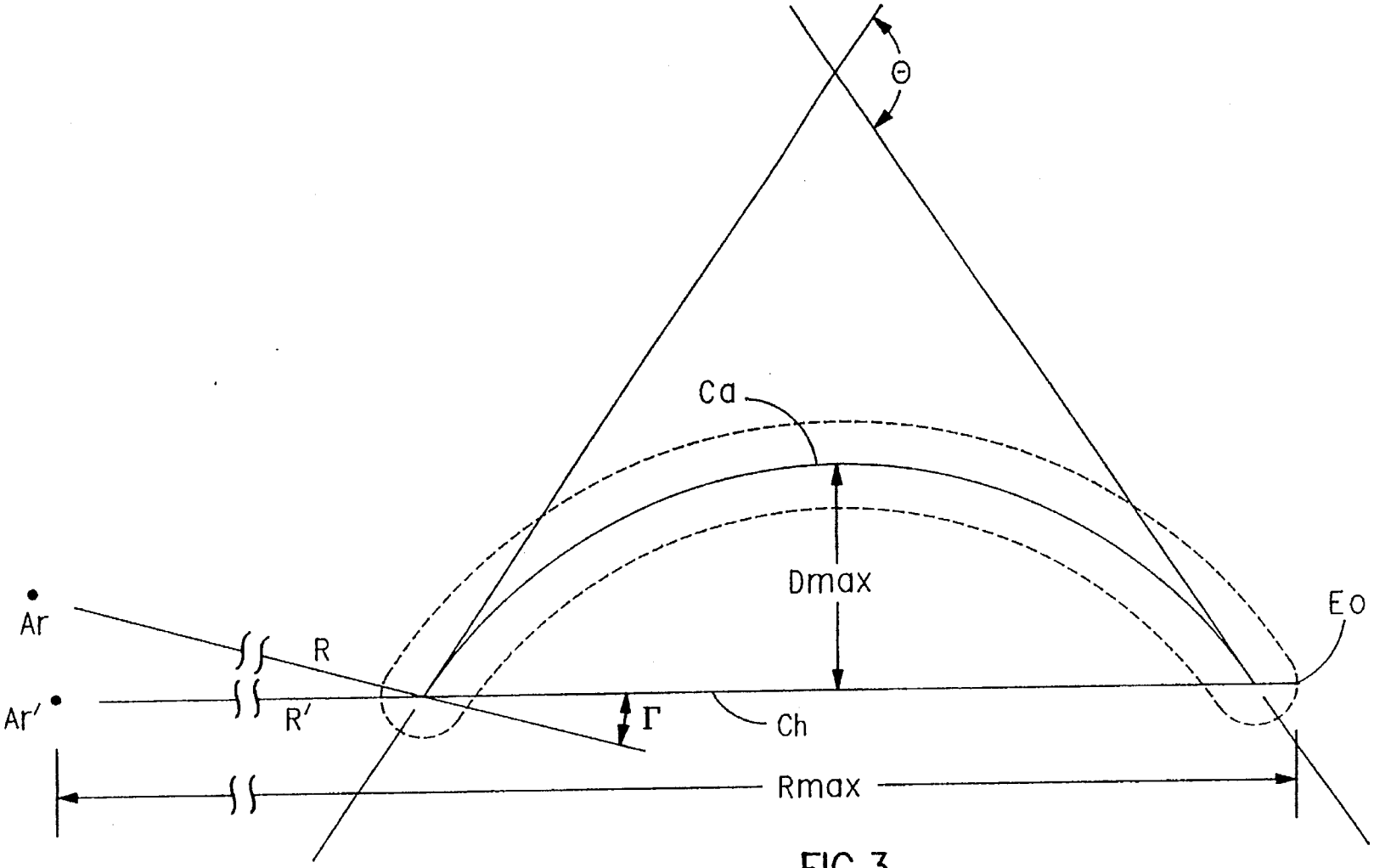
FIG. 3 is a schematic view of a section of a typical blade of a transverse fan impeller.

FIG. 3 depicts schematically a section of a typical blade of an impeller for a transverse fan. The figure shows blade camber line Ca and chord Ch. The maximum amount of deviation of camber line Ca from chord Ch is Dmax. Lines tangent to camber line Ca at its intersections with chord Ch intersect to form camber angle $\theta$. The angle between chord Ch and a radius R that passes through impeller axis of rotation Ar and the inner intersection of camber line Ca and chord Ch is setting angle $\Gamma$. In the same figure, A' is the impeller axis of rotation if blade setting angle $\Gamma$ is zero and Rmax is the radial distance, along radius R', from axis of rotation Ar' to outermost edge Eo of the blade.

Figure 4:
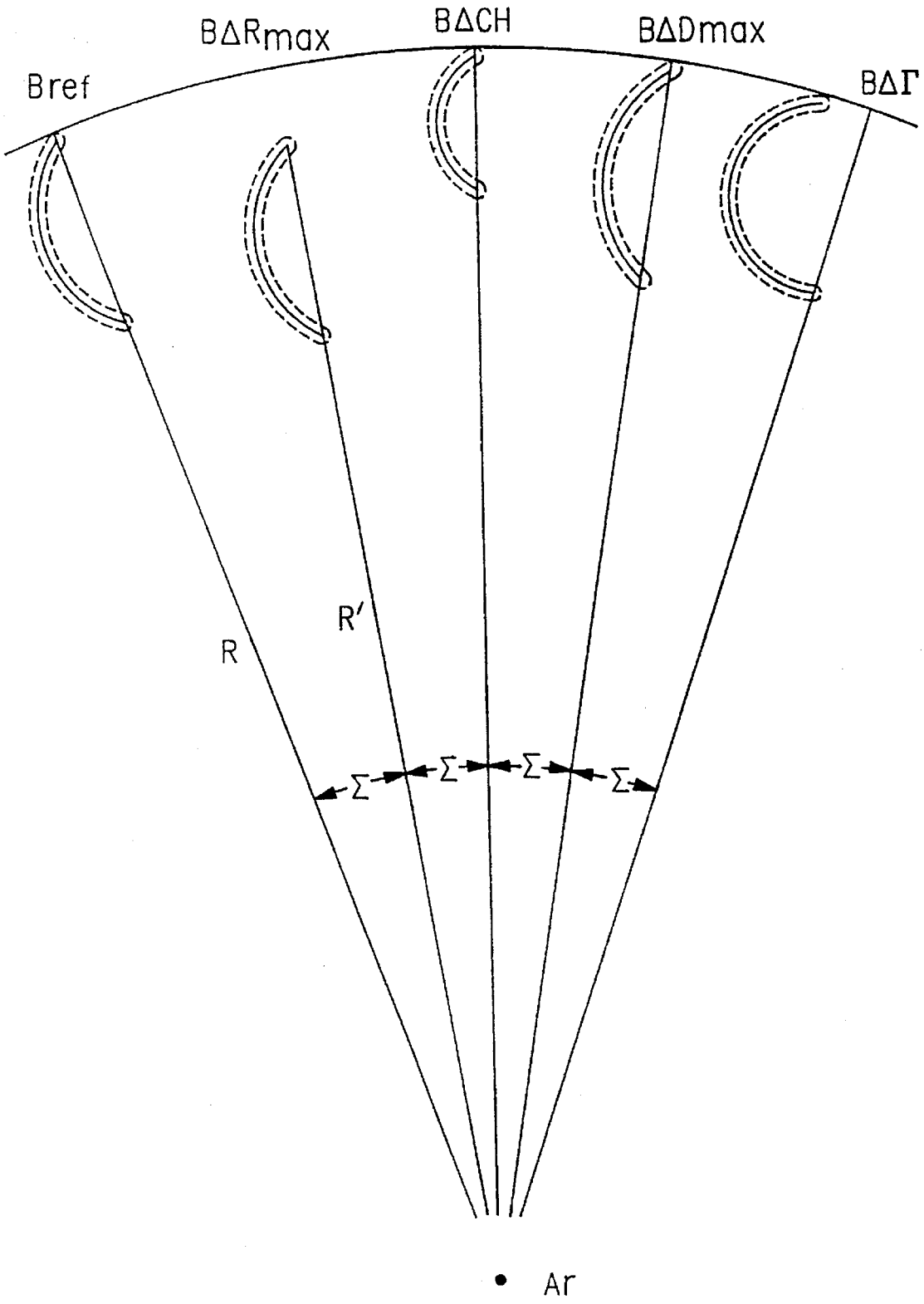
FIG. 4 is a schematic view of an arrangement of fan blades on a transverse fan impeller.

FIG. 4 shows, in lateral cross section, an arrangement of blades B on a transverse fan impeller. Blades B have equal angular spacing Σ between radii R, R' from impeller axis of rotation Ar and similar points on each blade. Blade Bref is a blade having reference values of distance from axis of rotation to blade outermost edge, blade chord, maximum deviation of camber from chord and setting angle. Blade BΔCh has a chord that deviates from the reference value. Blade BΔRmax has a distance from axis of rotation to blade outermost edge that deviates from the reference value. Blade BΔDmax has a camber line that has a maximum deviation of camber from chord that deviates from the reference value. Blade BΔF has a setting angle that deviates from the reference value.

In a transverse fan impeller embodying the present invention: the reference value for distance from axis of rotation to blade outermost edge is the longest such distance for any of the blades in the impeller; the reference value for blade chord is the length of the chord of the blade having the longest chord of any of the blades in the impeller; the reference value for camber is the average of the values of the maximum deviation between chord and camber line of all the blades in the impeller; and the reference value for setting angle is zero degrees.

It is known in the art that minor variations in the geometry of the blades of a transverse fan have little influence on the performance of the fan. There are, however, limits on the values of distance from rotational axis to blade outermost edge, chord length, camber and setting angle that, if exceeded, will adversely affect fan performance.

In one embodiment of the present invention, the distance from the impeller axis of rotation to blade outermost edge varies randomly among the blades from the reference value (Rmaxref). In this embodiment, the limits are from 0.9 to 1.0 times the reference value, or $$0.9\ Rmaxref < Rmax < 1.0\ Rmaxref.$$

In another embodiment of the present invention, the length of chord of the various blades varies randomly from the reference value (Chref). In this embodiment, the limits are from 0.5 to 1.0 times the reference chord length, or $$0.5\ Chref < Ch < 1.0\ Chref.$$

In another embodiment of the present invention, the maximum deviation from chord to camber of the various blades varies randomly from the reference value (Dmaxref). In this embodiment, the limits are from 0.5 to 1.0 times the reference value of maximum distance from chord to camber line or $$0.5\ Dmaxref < Dmax < 1.5\ Dmaxref.$$

In still another embodiment, it is the setting angle that varies, within limits, from the reference value (Γref). In this embodiment, the limits are from 15 degrees less to 15 degrees more than the reference setting angle or $$\Gamma ref - 15° < \Gamma < \Gamma ref + 15°.$$

A transverse fan impeller having blades among which the values of more than one, or all, of the various physical parameters discussed above would also be within the scope of the present invention.

It is possible that configuring the blades of a transverse fan impeller as described above will result in a small static imbalance. Any such imbalance can easily be overcome by adding appropriate compensating weights at appropriate positions on one or more of the fan disks.

We claim:

1. An improved impeller (30) for a transverse fan (10) of the type having a plurality of blades (31) longitudinally aligned parallel to and extending generally radially outward from the rotational axis (Ar) of said impeller, the improvement comprising each of said blades having a chord (Ch), a camber (Ca), a setting angle (Γ) and an outer edge (Eo) that is at a distance (Rmax) from the rotational axis; and among said plurality of blades, at least one of the values of maximum deviation of chord to camber (Dmax) or setting angle varies randomly with respect to a reference set of parameters, said reference set of parameters being a camber in which the maximum deviation between said camber and said chord is equal to the average of the maximum deviations of all blades in said plurality of blades, a setting angle of zero and a distance of outer edge from rotational axis equal to the largest of said distances among all blades in said plurality of blades.

2. The impeller of claim 1 in which maximum deviation from chord to camber is the value that varies.

3. The impeller of claim 2 in which the value of said maximum deviation varies from 0.5 to 1.5 time said reference maximum deviation.

4. The impeller of claim 1 in which setting angle is the value that varies.

5. The impeller of claim 4 in which said setting angle varies within ±15 degrees of said reference setting angle.

6. The impeller of claim 1 in which said distance of outer edge from rotational axis varies from 0.9 to 1.0 times said reference distance of outer edge from rotational axis.

* * * * *